US009296210B2

(12) United States Patent
Matsumoto

(10) Patent No.: US 9,296,210 B2
(45) Date of Patent: Mar. 29, 2016

(54) LIQUID EJECTING APPARATUS

(71) Applicant: SEIKO EPSON CORPORATION, Tokyo (JP)

(72) Inventor: Keiji Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/168,746

(22) Filed: Jan. 30, 2014

(65) Prior Publication Data

US 2014/0253632 A1 Sep. 11, 2014

(30) Foreign Application Priority Data

Mar. 7, 2013 (JP) ..... 2013-045078

(51) Int. Cl.
*B41J 2/165* (2006.01)

(52) U.S. Cl.
CPC ..... *B41J 2/16535* (2013.01); *B41J 2/1652* (2013.01); *B41J 2/16526* (2013.01); *B41J 2002/1655* (2013.01)

(58) Field of Classification Search
CPC ..... B41J 2/165
USPC ..... 347/29–33, 35, 36
See application file for complete search history.

(56) References Cited

U.S. PATENT DOCUMENTS

| | | | | |
|---|---|---|---|---|
| 8,727,490 | B2 * | 5/2014 | Kumagai et al. | 347/35 |
| 2001/0020962 | A1 | 9/2001 | Kanaya et al. | |
| 2003/0189614 | A1 | 10/2003 | Steinfield et al. | |
| 2008/0204506 | A1 * | 8/2008 | Nakamura et al. | 347/30 |
| 2010/0321453 | A1 * | 12/2010 | Baba | 347/102 |
| 2011/0043567 | A1 * | 2/2011 | Jung et al. | 347/33 |

FOREIGN PATENT DOCUMENTS

| | | |
|---|---|---|
| JP | 2000-168105 | 6/2000 |
| JP | 2003-300329 | 10/2003 |
| JP | 2004-276406 | 10/2004 |

* cited by examiner

*Primary Examiner* — Jason Uhlenhake
(74) *Attorney, Agent, or Firm* — Workman Nydegger

(57) ABSTRACT

A liquid ejecting apparatus includes: a liquid ejecting unit that has a liquid ejecting head moving back and forth in a scanning direction, the liquid ejecting head being provided with a nozzle surface in which nozzles capable of ejecting liquid are formed; a wiping portion that wipes the nozzle surface; a liquid receiving portion that is capable of receiving the liquid ejected through the nozzles; and a maintenance portion that performs maintenance on the liquid ejecting head. Further, a receiving area where the liquid receiving portion is provided is disposed at a position that is adjacent to a wiping area where the wiping portion is provided and is more distanced from a landing area where the liquid ejected through the nozzles toward an ejection target medium lands than the wiping area in the scanning direction.

9 Claims, 5 Drawing Sheets

LIQUID EJECTING APPARATUS

BACKGROUND

1. Technical Field

The present invention relates to liquid ejecting apparatuses that include a wiping portion configured to wipe a nozzle surface in which nozzles of a liquid ejecting head are formed, a liquid receiving portion configured to receive liquid ejected through the nozzles of the liquid ejecting head, and a maintenance portion configured to maintain the liquid ejecting head.

2. Related Art

An ink jet printer that prints (records) an image by ejecting ink, which is an example of liquid, from a liquid ejecting head onto a medium such as paper has been widely known as an example of a liquid ejecting apparatus (for example, JP-A-2000-168105 (paragraphs [0009], [0010], and [0033] and FIG. 1, and the like) and the like). A maintenance device is generally provided in such printer to maintain the ejection characteristics of the liquid ejected from the liquid ejecting head.

For example, in the printer described in JP-A-2000-168105, flushing areas (receiving areas) that receive ink droplets ejected through nozzles of a recording head (an example of a liquid ejecting head) are provided both in a non-print area on the side of a capping unit (cap) configured to seal the recording head and in another non-print area opposing the capping unit via a print area (landing area) positioned in the center. In addition, the capping unit has a moisturizing function that seals the recording head to prevent the nozzles from drying and configures part of a maintenance portion as well that performs cleaning in which a negative pressure from a suction pump is supplied into the recording head so as to suck and discharge ink through the nozzles.

A wiping member (an example of a wiping portion) is disposed on the side of the print area (landing area) in which ink droplets ejected from the recording head toward paper (an example of an ejection target medium) land, apart from a maintenance area where the capping unit is provided. The wiping member wipes a nozzle formation surface (nozzle surface) of the recording head when the recording head moves back and forth toward the capping unit side. The flushing area on the capping unit side is disposed at a position closer to the print area than a wiping area where the wiping member is disposed. As described above, the flushing area, the wiping area, and the maintenance area are disposed in that order from a side closer to the print area in a scanning direction in the known liquid ejecting apparatus.

However, in the case where the flushing area is disposed at a position close to the print area, the print area is likely to be soiled with mist generated in the flushing. As described above, in the case where a mist generation area is in the vicinity of the print area at the time of flushing, there has been a problem that a medium holding portion disposed in the print area and the ejection target medium are likely to be soiled. Note that this problem is not limited to a printer that ejects ink; that is, the problem occurs in general in liquid ejecting apparatuses that perform flushing in which liquid other than ink is ejected toward a liquid receiving portion at a position other than the print area.

SUMMARY

An advantage of some aspects of the invention is to provide a liquid ejecting apparatus that is capable of, without complex control, suppressing a landing area from being soiled due to mist generated at a time when a liquid ejecting head ejects liquid toward a liquid receiving portion.

A liquid ejecting apparatus according to an aspect of the invention includes: a liquid ejecting unit that has a liquid ejecting head which can move back and forth in a scanning direction, the liquid ejecting head being provided with a nozzle surface in which nozzles capable of ejecting liquid are formed; a wiping portion that wipes the above nozzle surface; a liquid receiving portion that is capable of receiving the liquid ejected through the nozzles; and a maintenance portion that performs maintenance on the liquid ejecting head. Further, a movement region in which the liquid ejecting head can move includes: a landing area where the liquid ejected through the nozzles toward an ejection target medium lands; a wiping area where the wiping portion is provided; a receiving area where the liquid receiving portion is provided; and a maintenance area where the maintenance portion is provided. Furthermore, the receiving area is disposed at a position that is adjacent to the wiping area and is more distanced from the landing area than the wiping area in the scanning direction.

According to this configuration, since the receiving area adjacent to the wiping area is located being distanced from the landing area at least by width of the wiping area, a mist generation area is separated from the landing area at the time when the liquid ejecting head ejects liquid toward the liquid receiving portion (flushing). This makes it possible to suppress the landing area (including a medium holding portion, the ejection target medium, and the like) from being soiled due to the mist.

It is preferable in the liquid ejecting apparatus that the maintenance portion include a cap capable of forming a sealed space by making contact with the nozzle surface, and the maintenance area be disposed at a position which is adjacent to the receiving area and is more distanced from the landing area than the receiving area in the scanning direction.

According to this configuration, the same effect can be obtained as the above liquid ejecting apparatus; moreover, minute particles (for example, paper powder or the like) scattering from the ejection target medium can be suppressed from adhering to a sealing surface of the cap, thereby making it possible to ensure sealing performance of the cap.

It is preferable that the liquid ejecting apparatus include a fixing section configured to fix the liquid that has landed on the ejection target medium in a region corresponding to the landing area in the scanning direction.

According to this configuration, it is possible to suppress the mist having adhered to the nozzle surface at a time of liquid ejection toward the liquid receiving portion (flushing) from solidifying. Further, in the case where the maintenance portion includes the cap, it is also possible to suppress the mist having adhered to the sealing surface of the cap from solidifying.

It is preferable in the liquid ejecting apparatus that the wiping portion be disposed in an exchangeable manner in a liquid ejecting apparatus main body.

According to this configuration, in the case where a wiping function of the wiping portion has been degraded, it is possible to maintain the wiping function by exchanging the wiping portion.

It is preferable in the liquid ejecting apparatus that the wiping portion include a fabric sheet and a support unit that supports part of the fabric sheet in a projected state so as to make the supported part be in contact with the nozzle surface, and the part of the fabric sheet supported by the support unit be provided in a changeable manner by moving the fabric sheet in a lengthwise direction thereof.

According to this configuration, by moving the fabric sheet, part of the fabric sheet that is supported by the support unit in a projected state is changed to be used for the next nozzle surface wiping. This makes it possible for the nozzle surface to be wiped with an unused part of the fabric sheet. Even if liquid in a used part of the fabric sheet is solidified due to the action of the fixing section, the nozzle surface will not be wiped by the solidified part. Accordingly, a wiping failure will not occur.

It is preferable in the liquid ejecting apparatus that the liquid receiving portion include a strip-shaped member having a liquid receiving surface and be configured so that a receiving range on the strip-shaped member can be changed by moving the strip-shaped member.

According to this configuration, because the receiving range on the strip-shaped member for the liquid that is ejected through the nozzles of the liquid ejecting head can be changed by moving the strip-shaped member, it is possible to suppress the liquid having adhered to the receiving range from being solidified due to the action of the fixing section. For example, peeling and scattering of a solidified object can be suppressed from occurring. Such solidified object is likely to be generated in a configuration in which the liquid is received in the same range each time.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an ink jet printer as an example of a liquid ejecting apparatus that prints images including characters, pictures, and so on by ejecting ink, will be described with reference to the drawings.

Figure 1:
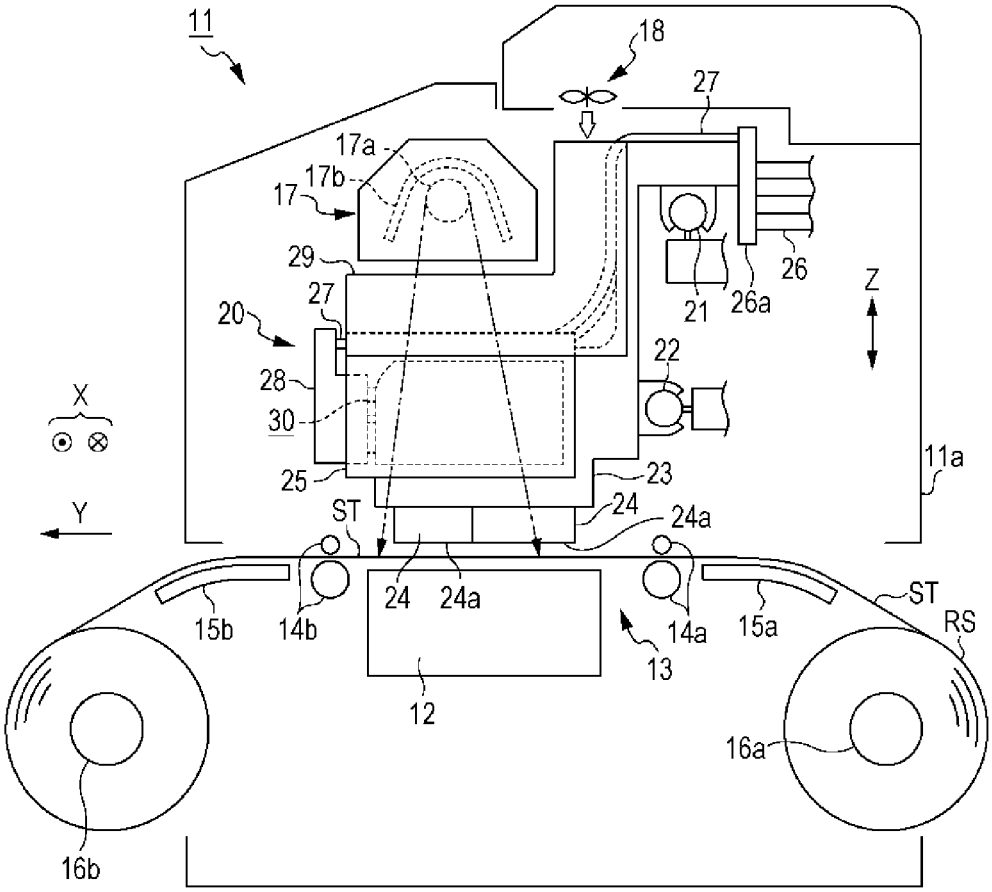
FIG. 1 is a schematic side view of a printer according to an embodiment of the invention.

As shown in FIG. 1, a printer 11 includes: a transport unit 13 configured to transport a sheet ST as an example of an ejection target medium that is supported on a support platform 12 (medium holding portion) along a surface of the support platform 12; a liquid ejecting unit 20 configured to eject ink, which is as an example of liquid, onto the sheet ST to be transported; and a heating portion 17 and a blower 18 for drying ink that has landed on the sheet ST. These constituent elements 12, 13, 17, 18 and 20 are installed in a printer main body 11*a* that is configured with a housing and a frame. In the printer 11, the support platform 12 is provided extending in a width direction of the sheet ST (front-back surface direction of the paper in FIG. 1). In this embodiment, an example of a fixing section is configured by the heating portion 17 and the blower 18 having a function that fixes ink on the sheet ST. Further, an example of a liquid ejecting apparatus main body is configured with the printer main body 11*a*.

The transport unit 13 includes a pair of transport rollers 14*a*, 14*b* driven by a driving source (not shown), and these paired transport rollers 14*a* and 14*b* rotate pinching the sheet ST so as to transport the sheet ST along the surface of the support platform 12 and the surfaces of a guide plate 15*a* and a guide plate 15*b* which are respectively provided on an upstream side and a downstream side in a transport direction Y of the support platform 12. In this embodiment, the sheet ST is continuously transported by being fed out from a roll RS wound on a supply reel 16*a* in a roll state. After an image is printed by the liquid ejecting unit 20 adhering ink to the sheet ST to be transported, the sheet ST is wound again on a winding reel 16*b* in a roll state.

The liquid ejecting unit 20 includes a carriage 23 that is capable of moving back and forth by power of a driving source (not shown) while being guided along guide shafts 21 and 22 that are extended along a scanning direction X, which is a width direction of the sheet ST intersecting with the transport direction Y of the sheet ST to be transported. On the carriage 23, a liquid ejecting head 24 configured to eject ink, a reservoir 30 for storing ink to be supplied to the liquid ejecting head 24, and a connection tube 27 configured to supply ink to the reservoir 30 via a flow path adaptor 28 are mounted. Further, the reservoir 30 is held by a reservoir holding member 25 mounted on the carriage 23.

The liquid ejecting head 24 is mounted on the lower side of the carriage 23 in a state in which a nozzle surface 24*a* (nozzle formation surface), where nozzles for ejecting ink are formed, faces the support platform 12 with a predetermined space (gap) therebetween in a vertical direction Z. Meanwhile, the reservoir 30 is mounted at the upper side of the carriage 23 opposite to the side of the liquid ejecting head 24 in the vertical direction Z. Further, a downstream side end of the connection tube 27 is connected to the flow path adaptor 28 at a higher position than the reservoir 30.

An upstream side end of the connection tube 27 is connected, via a connecting portion 26*a* attached to part of the carriage 23, to each downstream side end of a plurality of ink supply tubes 26 that are capable of deforming by following the carriage 23 that moves back and forth. Accordingly, ink from an ink tank (not shown) storing the ink is supplied to the reservoir 30 via the tubes 26, 27 and the flow path adaptor 28.

In the liquid ejecting unit 20, ink is ejected through the nozzles of the liquid ejecting head 24 toward the sheet ST on the support platform 12 while the carriage 23 is moving in the scanning direction X (moving back and forth). The heating portion 17 configured to heat and dry ink that has landed on the sheet ST is disposed at an upper position in the printer 11 spaced from the support platform 12 by a predetermined length in the vertical direction. The liquid ejecting unit 20 can move back and forth in the space between the heating portion 17 and the support platform 12 along the scanning direction X. The heating portion 17 includes a heating member 17*a* such as an infrared heater and a reflective plate 17*b* extending along the scanning direction X in which the support platform 12 also extends; in FIG. 1, ink having adhered to the sheet ST is heated by the heat of infrared light or the like that is radiated in an area indicated by dot-dash line arrows (for example, radiation heat). In addition, the blower 18 for drying the ink having adhered to the sheet ST by blowing air is disposed at an upper position in the printer 11 while ensuring a space from the support platform 12 in which the liquid ejecting unit 20 can move back and forth.

A heat shield member 29 configured to block heat transfer from the heating portion 17 is provided at a position between the reservoir 30 in the carriage 23 and the heating portion 17. The heat shield member 29 is formed of a metal member with high thermal conductivity such as stainless steel or aluminum, for example, and covers at least an upper surface portion of the reservoir 30 that faces to the heating portion 17.

In the printer 11, the reservoirs 30 are respectively provided for each ink type. In this example, the reservoirs 30 in which respective colored inks are stored are provided, and it is possible to perform color printing and black-and-white printing. Colors of the colored inks are, for example, cyan (C), magenta (M), yellow (Y), black (K), and white (W). In the case where a sheet ST is a transparent or semi-transparent film, or a deep color medium, for example, white (W) is used in foundation printing (solid printing (painting-out printing) or the like before the color printing being performed. Needless to say, colored inks to be used in the printing can be arbitrarily selected. For example, three colors of cyan (C), magenta (M) and yellow (Y) may be selected. Further, aside from the above three colors, the colored inks can additionally include at least one color from among light cyan, light magenta, light yellow, orange, green, and gray.

The colored ink does not substantially contain glycerin whose boiling point is 290° C. under 1 atmospheric pressure. If the colored ink substantially contains glycerin, a drying property of the ink is largely degraded. As a result, in various ejection target media, particularly, in a non-absorption or low-absorption ejection target medium, not only darkness unevenness in the image is unfavorably prominent, but also the fixity of the ink cannot be obtained. Moreover, it is preferable that a group of alkil-polyol (excluding the above glycerin) whose boiling point is equal to or more than 280° C. under a pressure equivalent to 1 atmospheric pressure not be substantially contained.

Here, in this specification, "does not substantially contain" means that "an amount of actual addition of a substance is less than the amount by which the added substance will bring a sufficiently meaningful result". To rephrase in a quantitative manner, it is preferable for glycerin to be contained less than 1.0 mass % with respect to a total mass (100 mass %) of a colored ink, more preferable to be contained less than 0.5 mass %, and further more preferable to be contained less than 0.1 mass %. Moreover, it is still further preferable for glycerin to be contained less than 0.05 mass %, particularly preferable to be contained less than 0.01 mass %, and most preferable to be contained less than 0.001 mass %.

Figure 2:
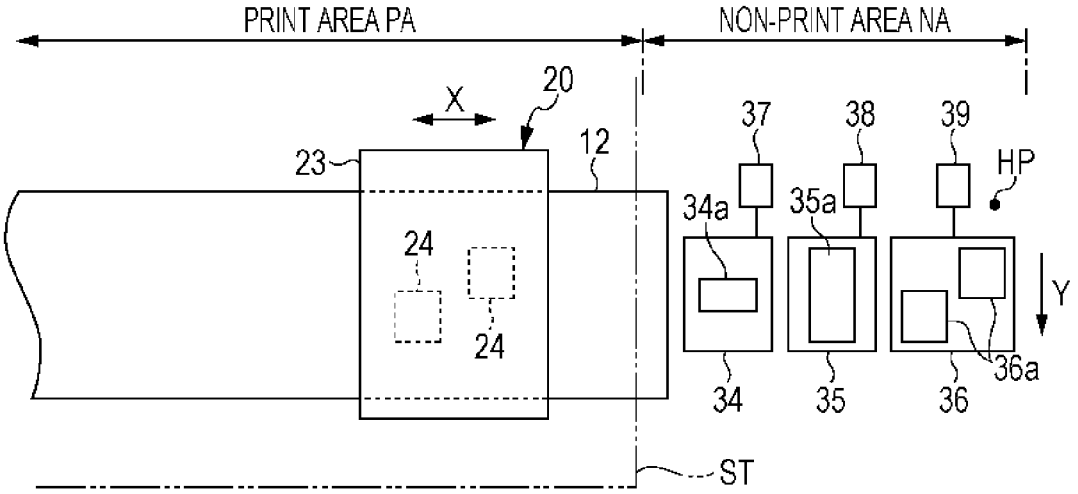
FIG. 2 is a schematic plan view illustrating a liquid ejecting unit and respective units of a maintenance system disposed in a non-print area.

As shown in FIG. 2, a maximal-width area in the scanning direction X where ink droplets ejected through the nozzles of the liquid ejecting head 24 can land on a maximal-width sheet ST transported on the support platform 12, is a print area PA as an example of a landing area. Ink droplets ejected through the nozzles of the liquid ejecting head 24 toward the sheet ST land within the print area PA.

As shown in FIG. 2, in a non-print area NA where the liquid ejecting head 24 capable of moving back and forth in the scanning direction X does not face the sheet ST to be transported, there are provided a wiper unit 34 as an example of a wiping portion, a flushing unit 35 as an example of a liquid receiving portion, and a cap unit 36 as an example of a maintenance portion. In the case where the liquid ejecting unit 20 has a borderless printing function, the print area PA is slightly wider in the scanning direction X than a range of the maximal-width sheet ST to be transported.

As shown in FIG. 2, the wiper unit 34 includes a wiper 34*a* for wiping the nozzle surface 24*a* (see FIG. 1). The wiper 34*a* of this example is a mobile type, and performs wiping operation using power of a wiping motor 37. The flushing unit 35 includes a liquid receiving portion 35*a* configured to receive ink droplets ejected through the nozzles of the liquid ejecting head 24. The liquid receiving portion 35*a* of this example is configured with a belt; at a predetermined time when the amount of ink dirt on the belt due to the flushing can be considered to have exceeded a set value, the belt is moved with power of a flushing motor 38. Note that "flushing" is an operation in which ink droplets are forced to be ejected (discharged) through all the nozzles regardless of printing so as to prevent or remove clogging or the like of the nozzles.

The cap unit 36 illustrated in FIG. 2 includes two cap portions 36*a* capable of making contact with the nozzle surfaces 24*a* of the two liquid ejecting heads 24 (see FIG. 1). The two cap portions 36*a* move with power of a capping motor 39 between the contact positions where they can respectively make contact with the nozzle surfaces 24*a* and the retreat positions where they can be respectively distanced from the nozzle surfaces 24*a*. A position at which the liquid ejecting head 24 is capped by the corresponding cap portion 36*a* is a home position HP of the liquid ejecting head 24 (or the carriage 23).

Figure 3:
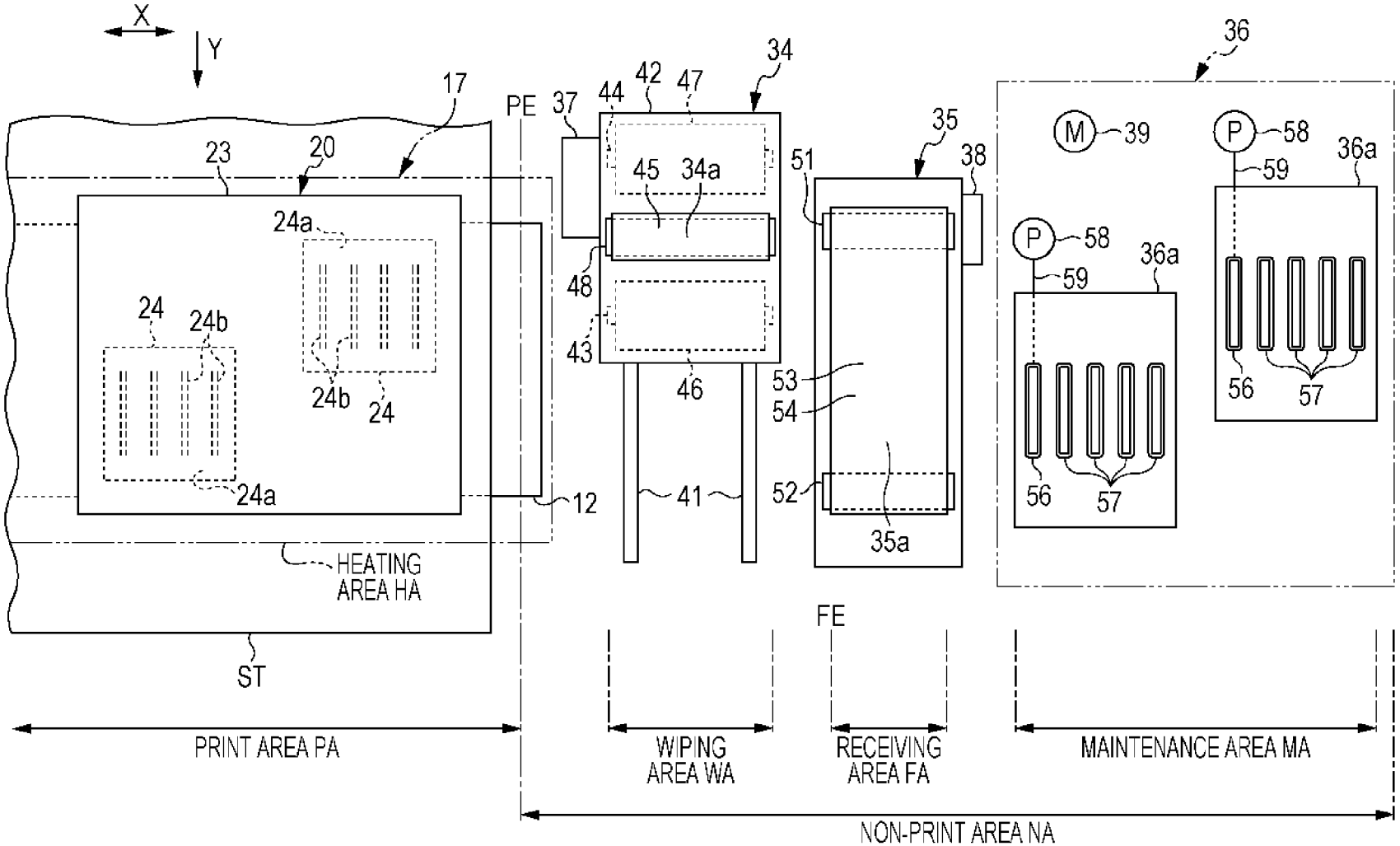
FIG. 3 is a schematic plan view illustrating the detailed configurations of the liquid ejecting unit and the respective units of the maintenance system disposed in the non-print area.

As shown in FIG. 3, the two liquid ejecting heads 24 provided on the lower surface of the carriage 23 are disposed being separated from each other by a predetermined distance in the scanning direction X and also being shifted from each other by a predetermined length in the transport direction Y. A total of eight nozzle rows 24*b* are formed on the nozzle surface 24*a* of the liquid ejecting head 24, in which every two closely-positioned rows are arranged at a predetermined interval in the scanning direction X.

Figure 5:
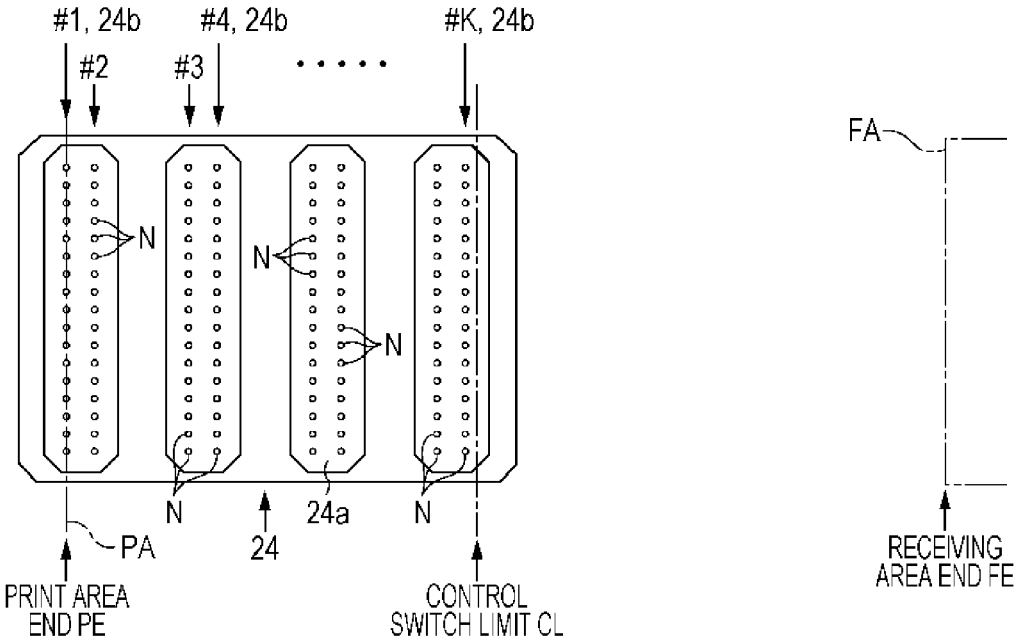
FIG. 5 is a schematic bottom view illustrating a positional relationship between a liquid ejecting head and a receiving area.

More specifically, as shown in FIG. 5, the eight nozzle rows 24*b* formed on the nozzle surface 24*a* are each configured of a plurality of nozzles N (for example, 180 in number) that are formed at a constant pitch in the transport direction Y. The two liquid ejecting heads 24 have a positional relationship in the transport direction Y so that in the case where the plurality of nozzles N configuring the respective nozzle rows 24*b* are projected in the scanning direction X, a nozzle pitch between the nozzles of each end of the respective nozzle rows can be the same as the pitch mentioned above.

As shown in FIG. 3, the wiper unit 34 includes a mobile-type housing 42 that is capable of moving back and forth with the power of the wiping motor 37 on a pair of rails 41 extending along the transport direction Y. In the housing 42, a feed-out shaft 43 and a winding shaft 44 are supported in a rotatable manner; these two shafts are positioned being separated from each other by a predetermined distance in a wiping direction (same as the transport direction Y). A feed-out roll 46 on which an unused fabric sheet 45 is wound is mounted on the feed-out shaft 43, while a winding roll 47 on which a used fabric sheet 45 is wound is mounted on the winding shaft 44. The fabric sheet 45 stretched between the rolls 46 and 47 is wound upon the upper surface of a pushing roller 48 that is partly projected upward from an opening (not shown) at a central portion in the upper surface of the housing 42, and the portion of the fabric sheet 45 that is wound upon the pushing roller 48 forms the wiper 34*a* having a half-cylinder shape (formed in a projecting shape). The wiper 34*a* is in a state of being biased toward the upper side. Although the wiping direction is made to be the same as the transport direction Y, the wiping direction may be the same as the scanning direction X. Note that in this embodiment, the pushing roller 48 configures an example of a support unit that supports the fabric sheet 45 in a projected state.

The housing 42 is configured of a cassette that accommodates the rolls 46, 47 and a holder that can move back and forth in the wiping direction Y with the power of the wiping motor 37 via a not-illustrated power transmission mechanism (for example, a rack-and-pinion mechanism). When the wiping motor 37 makes normal rotation and reverse rotation, the housing 42 makes one back-and-forth movement in the transport direction Y between the retreat position shown in FIG. 3 and a wiping position at which the wiper 34*a* finishes the wiping of the nozzle surface 24*a*. In this case, when the housing 42 has ended a forward movement, the power transmission mechanism switches to a state in which the wiping motor 37 and the winding shaft 44 are connected so that the power transmission is available therebetween, thereafter a backward movement of the housing 42 with reverse rotation power of the wiping motor 37 and a winding operation that winds the fabric sheet 45 on the winding roll 47 by a predetermined amount are carried out. The two liquid ejecting heads 24 are sequentially placed in a wiping area WA, and the wiping of the nozzle surface 24*a* per back-and-forth movement of the housing 42 is performed on the liquid ejecting heads 24 that are placed in the wiping area WA one by one.

As shown in FIG. 3, the flushing unit 35 includes a drive roller 51 and a driven roller 52 that are in parallel and face each other in the transport direction Y, and an endless belt 53 that is windingly stretched between the rollers 51 and 52. The belt 53 having a width equal to or larger than four nozzle rows' worth of width in the scanning direction X is the liquid receiving portion 35*a* that receives ink ejected through the nozzles N of the liquid ejecting head 24. Further, the outer circumferential surface of the belt 53 is a liquid receiving surface 54. The flushing unit 35 includes, on the lower side of the belt 53, a moisture liquid supply member capable of supplying a moisture liquid to the liquid receiving surface 54 and a liquid scraping member configured to scrape away waste ink or the like having adhered to the liquid receiving surface 54 in a moisturized state (these two members are not illustrated); thus the waste ink received by the liquid receiving surface 54 is removed from the belt 53 with the liquid scraping member. Accordingly, the revolving movement of the belt 53 updates a receiving range of the liquid receiving surface 54 that opposes the nozzle surface 24*a*. Note that the belt 53 of this embodiment configures an example of a strip-shaped member.

The cap unit 36 shown in FIG. 3 includes the two cap portions 36*a* each capable of forming a sealed space by making contact with the respective nozzle surfaces 24*a* of the two liquid ejecting heads 24. These two cap portions 36*a*, as described earlier, move with the power of the capping motor 39 between the contact positions where they can respectively make contact with the nozzle surfaces 24*a* and the retreat positions where they can be respectively distanced from the nozzle surfaces 24*a*. Each of the cap portions 36*a* has one suction cap 56 and four moisture caps 57. Each cap 57 forms a sealed space, by making contact with the nozzle surface 24*a*, that encloses each two nozzle rows 24*b*, and moisturizes the space inside the cap 57. To be more specific, ink within the nozzles N opening within the cap 57 is moisturized by a dispersion medium or a solvent that is contained in the waste ink or the like remaining in the cap 57 (water or the like, for example), alternatively moisturized by evaporation or volatilization of the moisture liquid.

As shown in FIG. 3, the suction cap 56 is connected with a suction pump 58 via a tube 59. The suction pump 58 is driven in a situation in which the cap 56 is in contact with the nozzle surface 24*a* to form a sealed space; then a predetermined amount of ink is sucked and discharged by action of a negative pressure supplied in the cap 56 so that thickened ink within the nozzles N, air bubbles in the ink, and so on are sucked and discharged. This suction cleaning is performed on each two nozzle rows 24*b* in each of the liquid ejecting heads 24. After the suction cleaning, wiping operation to remove the ink adhering to the nozzle surface 24*a* and flushing operation to adjust the meniscus of ink within the nozzles N are sequentially carried out.

As shown in FIG. 3, a movement region where the liquid ejecting head 24 can move in the scanning direction X includes the print area PA in which ink ejected through the nozzles N of the liquid ejecting head 24 can be landed at the time of printing on the sheet ST and the area other than the print area PA, that is, the non-print area NA. The non-print area NA includes the wiping area WA in which the wiper unit 34 is provided, the receiving area FA (flushing area) in which the flushing unit 35 is provided, and the maintenance area MA in which the cap unit 36 is provided. In the example in FIG. 3, in particular, an arrangement area of the wiper 34*a* in the wiper unit 34 is the wiping area WA. Further, in the flushing unit 35, an arrangement area of the liquid receiving portion 35*a* (that is, the belt 53) is the receiving area FA. Furthermore, in the cap unit 36, an arrangement area including the two caps 56, 57 is the maintenance area MA.

As shown in FIG. 3, the receiving area FA is adjacent to the wiping area WA in the scanning direction X and is disposed at a position more distanced from the print area PA than the wiping area WA. Accordingly, the wiping area WA is disposed between the print area PA and the receiving area FA in the scanning direction X. This makes the receiving area FA be positioned being distanced from the print area PA by an amount in width of the wiping area WA sandwiched between the receiving area FA and the print area PA.

The maintenance area MA is adjacent to the receiving area FA in the scanning direction X and is disposed at a position more distanced from the print area PA than the receiving area FA. Accordingly, the wiping area WA and the receiving area FA are disposed between the print area PA and the maintenance area MA in the scanning direction X. This makes the maintenance area MA be positioned more distanced from the print area PA than the receiving area FA by an amount in widths of the wiping area WA and the receiving area FA sandwiched between the maintenance area MA and the print area PA. As described above, in the non-print area NA, the wiping area WA, the receiving area FA, and the maintenance area MA are arranged in that order from the print area PA side in the scanning direction X.

Further, as shown in FIG. 3, in a region corresponding to the print area PA in the scanning direction X, there is disposed a heating area HA in which the heating portion 17 configured to heat and fix ink that has landed on the sheet ST is provided. Accordingly, the receiving area FA is disposed at a position more distanced from the heating area HA than the wiping area WA in the scanning direction X. Further, the maintenance area MA is disposed at a position more distanced from the heating area HA than the receiving area FA in the scanning direction X.

Next, an electrical configuration of the printer 11 will be described.

Figure 4:
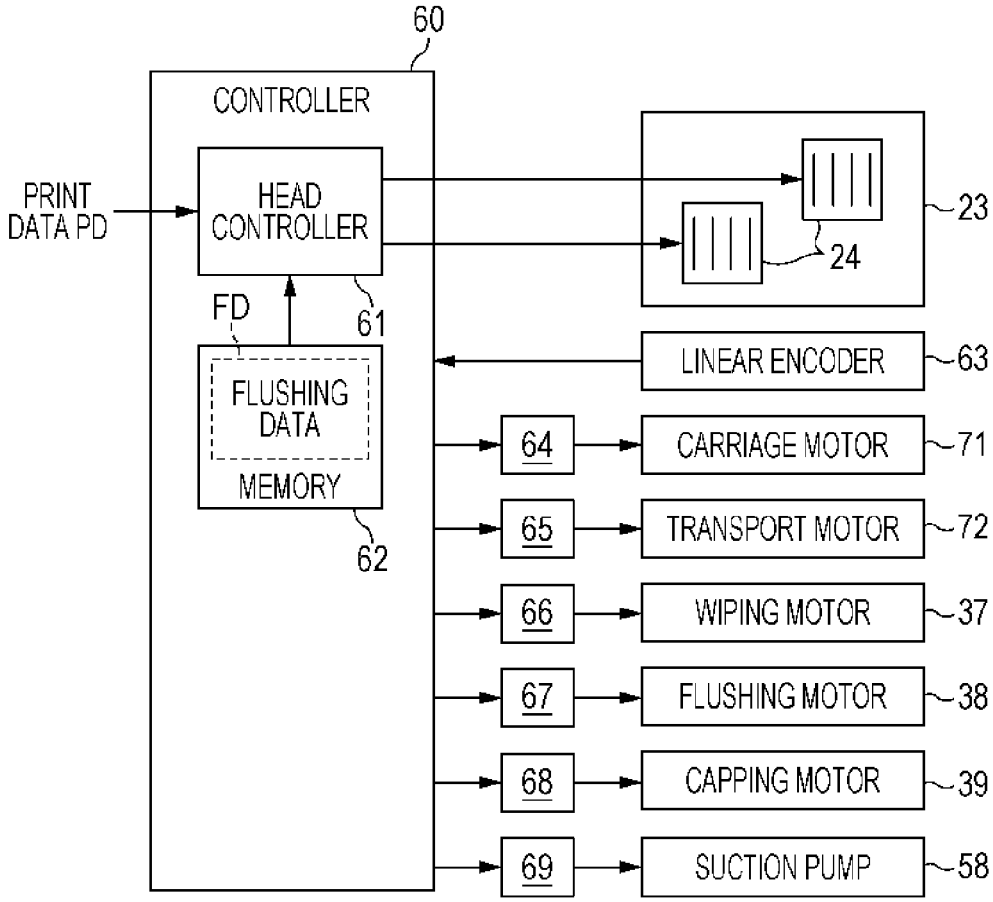
FIG. 4 is a block diagram illustrating an electrical configuration of a printer.

As shown in FIG. 4, the printer 11 includes a controller 60 that manages print control, maintenance control, and so on. The controller 60 accepts print data PD that the printer 11 has received from a host apparatus (not shown), for example, which is connected with the printer 11 by wire or wirelessly in a communicable manner. The controller 60 has a head controller 61 that performs ejection control of the liquid ejecting head 24 based on the print data, and a memory 62 that stores reference data and the like used in various kinds of control including the ejection control, carriage control, and transport control.

The print data PD contains a print command and print image data of different colors of C, M, Y, K and white (W) corresponding to the respective nozzle rows 24*b*. Each color print image data contains binary data (dot value) indicating discharge or non-discharge for each ink dot. For example, in the case where the dot value is "1", ink is discharged, while in the case where the dot value is "0", ink is not discharged. Further, in the liquid ejecting head 24 having a function that discharges print dots in three sizes, the dot value is given in binary data of two or three bits. In the case where there is provided a function in which the print dots are discharged in sizes of "large", "middle" and "small", for example, a large-size dot is discharged if the dot value is "11", a middle-size dot is discharged if it is "10", a small-size dot is discharged if it is "01", and no dot is discharged if it is "00".

In the memory 62 shown in FIG. 4, flushing data FD which is used in the flushing by the liquid ejecting head 24 is stored, for example. The flushing data FD also contains flushing image data of different colors of C, M, Y, K and white (W) corresponding to the respective nozzle rows 24*b*. The head controller 61 is electrically connected with the two liquid ejecting heads 24. The head controller 61 separately controls the two liquid ejecting heads 24 based on the print data PD. Further, the head controller 61, at the time of flushing, separately controls the liquid ejecting heads 24 based on the flushing data FD that is read out from the memory 62 and performs flushing of a quantity of ejection and a number of times based on the flushing data FD.

The head controller 61, based on the print image data of the respective colors contained in the print data PD or the flushing data FD, controls driving of not-shown ejection driving elements (for example, piezoelectric elements or heater elements) provided for the nozzles N which constitute the nozzle rows 24*b* corresponding to the respective colors.

Further, as shown in FIG. 4, a linear encoder 63 is connected to the controller 60. The linear encoder 63 has a tape-shaped code plate that is so provided on the rear side of the carriage 23 as to extend along the guide shaft 22 and a sensor configured to detect light that passes slits bored at a constant pitch in the code plate affixed to the carriage 23. The controller 60 receives pulses of the number proportional to a movement amount of the liquid ejecting unit 20 from the linear encoder 63; the number of received pulses is added when the liquid ejecting unit 20 moves away from the home position HP and subtracted when the ejecting unit approaches the home position HP so that the controller 60 grasps the position of the liquid ejecting unit 20 in the scanning direction X.

The controller 60 is electrically connected with a carriage motor 71, a transport motor 72, the wiping motor 37, the flushing motor 38, and the capping motor 39 via motor driving circuits 64 through 68, respectively. In addition, the suction pump 58 is electrically connected with the controller 60 via a driving circuit 69. The controller 60, according to a command in the print data, outputs control signals to the motor driving circuits 64 and 65 so as to control driving of the carriage motor 71 and the transport motor 72. The suction pump 58 may be so configured as to be driven using power of the transport motor 72.

The controller 60 controls the driving of the carriage motor 71 based on the output pulses of the linear encoder 63 so as to control the position and speed of the carriage 23. Further, the controller 60 controls the driving of the transport motor 72 so as to feed and transport the sheet ST. Furthermore, in the case where the controller 60 determines that a maintenance execution condition is satisfied, the controller 60 controls the carriage 23 to move to a predetermined position on the home position HP side, then controls driving of at least one of the wiper unit 34 and the cap unit 36 so as to perform at least one of the wiping and cleaning operations.

The controller 60 controls the driving of the carriage motor 71 according to the print command so as to move the carriage 23 in the scanning direction X. Further, the controller 60 controls the driving of the transport motor 72 according to the print command so as to control the feed and transport of the sheet ST. In the printer 11 of a serial type, under control of the controller 60, printing is performed by alternately repeating the following operations in general: that is, one is a printing operation in which ink droplets are ejected through the nozzles N of the liquid ejecting head 24 during movement of the carriage 23 in the scanning direction X for recording on the sheet ST; the other is a transporting operation in which the sheet ST is transported to a next print position.

The controller 60 controls driving of the wiping motor 37 so as to make the wiper unit 34 perform a wiping operation. In the case where a predetermined cleaning condition is satisfied, the controller 60 causes the liquid ejecting unit 20 to move to the home position HP, and causes the cap portion 36*a* to move upward so that the cap portion 36*a* makes contact with the nozzle surface 24*a*. Thereafter, the inside of the cap 56 is made to be at a negative pressure by driving the suction pump 58, and ink is forcibly sucked and discharged from the nozzles N to perform cleaning of the nozzles N. After the suction cleaning has ended, the wiping and flushing operations are sequentially carried out; then, if a next print is in a waiting state for the printing operation, the liquid ejecting unit 20 moves toward the print area PA to perform printing on the sheet ST.

As shown in FIG. 5, the liquid ejecting head 24 includes the nozzle rows 24*b* in K rows (eight rows in this example). The K nozzle rows are respectively called a first row #1, a second row #2, . . . , and a K-th row #K in the order from the side opposite to the home position (left side in FIG. 5). Of the nozzle rows 24*b* in K rows, the head controller 61 performs flushing control on the nozzle rows 24*b* within the receiving area FA based on the flushing data FD, and performs the print control on the nozzle rows 24*b* within the print area PA based on the print data PD. In this embodiment, when the #1 nozzle row 24*b* of the liquid ejecting head 24 reaches a print area end PE that is an end of the print area PA on the home position HP side, a control switch limit CL is not within the receiving area FA; the control switch limit CL is a limit position within which any part of the nozzle rows 24*b* up to the #K row need not be switched to other control. In other words, in the case where the liquid ejecting head 24 moves from the receiving area FA to the print area PA, at the time when the first nozzle row 24*b* starts the print control, the K-th nozzle row 24*b* has already finished the flushing. Further, in the case where the liquid ejecting head 24 moves from the print area PA to the receiving area FA, at the time when the first nozzle row 24*b* finishes the print control, the K-th nozzle row 24*b* has not started the flushing yet.

Accordingly, it is unnecessary for the head controller 61 to make a single liquid ejecting head 24 carry out different kinds of control on the nozzle rows 24*b* in K rows at the same time. In other words, because the print area PA and the flushing unit 35 are positioned being distanced from each other at least by an amount of width of the wiper unit 34 disposed therebetween, the head controller 61 need not make the single liquid ejecting head 24 carry out both the print control on part of the nozzle rows 24*b* of the K rows and the flushing control on other part of the nozzle rows 24*b* at the same time in a mixed manner.

Next, action of the printer 11 will be described hereinafter.

The controller 60 controls the driving of the carriage motor 71 based on the print data PD so as to make the liquid ejecting unit 20 move in the scanning direction X; during this movement of the liquid ejecting unit 20, ink droplets are ejected from the liquid ejecting head 24 toward a surface of the sheet ST. Then, an image or the like is printed on the surface of the sheet ST by the ink droplets landing on the surface of the sheet ST. In the printer 11 of a serial type, under control of the controller 60, printing is performed by alternately repeating the following operations in general: that is, one is a printing operation in which ink droplets are ejected through the nozzles N of the liquid ejecting head 24 during the movement of the liquid ejecting unit 20 in the scanning direction X for printing on the sheet ST; the other is a transport operation in which the sheet ST is transported to a next print position.

During the printing, in order to prevent thickening or the like of ink within the nozzles N that do not eject ink droplets from among all the nozzles N, the liquid ejecting unit 20 moves to the receiving area FA at a predetermined time (for example, every time when a predetermined time within the range of 10 to 30 seconds has elapsed) and performs flushing in which ink droplets are ejected through all the nozzles N to discharge ink within the nozzles N. Mist is generated at the time of flushing; however, the receiving area FA is adjacent to the wiping area WA and is disposed at a position more distanced from the print area PA than the wiping area WA in the scanning direction X.

Accordingly, the mist generation area at the time of flushing toward the liquid receiving portion 35*a* by the liquid ejecting head 24 in the scanning is distanced from the print area PA. This suppresses the support platform 12 (medium holding portion) and the sheet ST (ejection target medium) positioned in the print area PA from being soiled.

The maintenance area MA is disposed at a position that is adjacent to the receiving area FA and is more distanced from the print area PA than the receiving area FA in the scanning direction X. The sheet ST slidingly moves on the support platform 12, a surface guide surface (not shown), and so on, and as a result, dust or the like scatters from the portions where the sheet ST slides. In particular, in the case where the sheet ST is paper, fabric or the like, paper powder, dust (fine fiber), or the like is likely to scatter from the portions where the sheet ST slides during being transported. Since the maintenance area MA of this example is more distanced from the print area PA than the receiving area FA in the scanning direction X, minute particles (paper power or the like) scattering from the sheet ST are suppressed from adhering to sealing surfaces of the caps 56 and 57, thereby maintaining the sealing performance of the caps 56 and 57.

In order to fix the ink having landed on the sheet ST, a region corresponding to the print area PA is heated by the heating portion 17 during the printing. However, since the receiving area FA is more distanced from the heating area HA than the wiping area WA, the receiving area FA is unlikely to be heated. This makes it possible to suppress the mist having adhered to the nozzle surface 24*a* in the flushing toward the liquid receiving portion 35*a* from being solidified by the heat.

The maintenance area MA is disposed at a position that is adjacent to the receiving area FA and is more distanced from the print area PA and the heating area HA than the receiving area FA in the scanning direction X. This makes it possible to suppress the mist having adhered to the sealing surfaces of the caps 56 and 57 from being solidified by the heat as well.

The wiper unit 34 that is disposed in the non-print area NA and is the closest to the heating area HA in the scanning direction X can be exchanged. Therefore, in the case where the wiping function of the wiper 34*a* is degraded, a cassette having the wiper 34*a* therein is taken out from a holder on the printer main body 11*a* side so as to exchange the wiper 34*a*, thereby making it possible to maintain the wiping function. In addition, the fabric sheet 45 is wound every time the wiping operation is performed so that the sheet on a wiping area forming the wiper 34*a* in a projected manner is changed to new one, whereby the wiping function of the wiper 34*a* is unlikely to be degraded although it is relatively closer to the heating area HA. In other words, it is possible to avoid such a problem that the nozzle surface is wiped by a used part of the sheet in which the wiped ink has solidified so as to be caused a wiping failure of the wiper 34*a*.

The flushing unit 35 is of a belt type. Accordingly, by revolving the belt 53 at a predetermined time when waste ink having landed on the belt 53 in the flushing has accumulated to some extent, the receiving range on the belt 53 that can face the nozzle surface 24*a* is updated anew. In this case, the waste ink on the liquid receiving surface 54 is moisturized by a moisture liquid at the lower side of the belt 53, and is then scraped away from the outer circumferential surface of the belt 53 by a liquid scraping member. Therefore, scattering matter generated when waste ink having solidified in the receiving area FA peels and scatters in minute particles, is not actually generated. Thus, the following are avoided: that is, the sheet ST and the support platform 12 within the print area PA are soiled by the above scattering matter; the wiping function is degraded due to the scattering matter having adhered to the wiper 34*a*; and a sealing function is degraded due to the scattering matter having adhered to the sealing surfaces of the caps 56 and 57. In addition, although the receiving area FA is closer to the heating area HA, second to the wiping area WA, peeling and scattering of the solidified object can be prevented because the waste ink on the belt 53 is scraped away in a moisturized state. Further, because the cap unit 36 is disposed at a position that is more distanced from the heating area HA (print area PA) in the scanning direction X than other units 34, 35 having a waste ink removing function, mist or the like having adhered to the sealing surfaces of the caps 56 and 57 is unlikely to dry and solidify so that the sealing function is unlikely to be degraded.

In the case where it is set that wiping should be performed during the printing so as to remove mist, ink, or the like having adhered to the nozzle surface 24*a* of the liquid ejecting head 24 every time a certain amount of printing (for example, a predetermined number of sheets within the range of 1 to 10 pages) has been made, the execution frequency of flushing is the largest, that of wiping is the second largest, and that of suction cleaning is the lowest during the printing. In this embodiment, at the time of wiping, whose execution frequency is the second largest next to that of flushing, a distance that the liquid ejecting head 20 moves from the print area PA to the wiping area WA is preferably shorter. Accordingly, decrease in printing throughput is suppressed lower even if wiping is performed during the printing.

In the case where a predetermined cleaning condition is satisfied, the controller 60 controls the carriage motor 71 to move the liquid ejecting unit 20 to the home position HP. In the cleaning, the cap 56 makes contact with the nozzle surface 24*a* to form a sealed space, a negative pressure is supplied to the inside of the cap 56 by driving the suction pump 58, and a predetermined amount of ink is sucked and discharged from the nozzle N to remove thickened ink, air bubbles, and so on. After the cleaning, the liquid ejecting unit 20 is moved to the wiping area WA where the nozzle surface 24*a* is wiped by the wiper 34*a*. Subsequently, the liquid ejecting unit 20 is moved to the receiving area FA where flushing is made toward the liquid receiving portion 35*a*. At this time, if a print job is in a waiting state for the printing operation, the liquid ejecting unit 20 moves from the receiving area FA to the print area PA after the flushing.

At the time of flushing during the printing described earlier, the liquid ejecting unit 20 moves from the print area PA to the receiving area FA, performs the flushing, then moves from the receiving area FA to the print area PA. During the movement of the liquid ejecting unit 20 between the receiving area FA and the print area PA, the head controller 61 performs the following ejection control. Explanation will be given using an example in which ink droplets are ejected at the print area end PE.

As shown in FIG. 5, a relatively longer space is ensured corresponding to the arrangement space of the wiper unit 34 between the print area PA and the flushing unit 35 in the scanning direction X. Accordingly, when the #1 nozzle row 24*b* of the liquid ejecting head 24 reaches the print area end PE, the control switch limit CL is positioned closer to the print area PA side than a receiving area end FE and is not within the receiving area FA.

As a result, of the K nozzle rows 24*b* in a single liquid ejecting head 24, the head controller 61 performs print control on at least part of the nozzle rows 24*b* within the print area PA, or performs flushing control on at least part of the nozzle rows 24*b* within the receiving area FA. In other words, the head controller 61 is required to perform any one of the flushing control and the print control on a single liquid ejecting head 24, and is not required to perform complex control in which both the flushing control and print control are performed at the same time in a mixed manner. This makes it possible for the head controller 61 to perform the print control and the flushing control in a simplified control manner.

According to the above embodiment, the following effects can be obtained.

1. In the non-print area NA, the wiper unit 34, the flushing unit 35, and the cap unit 36 are disposed in that order from the print area PA side. In other words, the receiving area FA is disposed at a position that is adjacent to the wiping area WA and is more distanced from the print area PA than the wiping area WA in the scanning direction X. Accordingly, the mist generation area at the time of flushing toward the liquid receiving portion 35*a* by the liquid ejecting head 24 is distanced from the print area PA. This makes it possible to suppress the support platform 12 and the sheet ST within the print area PA from being soiled without complex control.

2. The maintenance area MA is disposed at a position that is adjacent to the receiving area FA and is more distanced from the print area PA than the receiving area FA in the scanning direction X. Accordingly, it is possible to suppress minute particles (paper powder or the like) scattering from the sheet ST from adhering to the sealing surfaces of the caps 56 and 57.

3. In the scanning direction X, the receiving area FA is more distanced than the wiping area WA from the heating area HA where the heating portion 17 configured to heat and fix ink on the sheet ST is provided. This makes it possible to suppress the mist having adhered to the nozzle surface 24*a* in the flushing from being solidified by the heat.

4. The wiper unit 34 includes the fabric sheet 45 and the pushing roller 48 that supports part of the fabric sheet 45 in a projected state, and can change a portion of the sheet being supported by the pushing roller 48 by moving the fabric sheet 45 in a lengthwise direction thereof. Even if ink having been wiped by the fabric sheet 45 solidifies due to the heat of the heating portion 17 (an example of a fixing section), the wiping failure can be suppressed because the solidified portion in the fabric sheet 45 is not used again for wiping the nozzle surface 24*a*.

5. The flushing unit 35 is of a belt type including the belt 53 (an example of a strip-shaped member). The receiving range for receiving ink droplets at the time of flushing can be changed by revolutionarily moving the belt 53. It is possible to suppress the ink having adhered to the receiving range from being solidified due to the heat of the heating portion 17. For example, it is possible to suppress scattering matter generated when a solidified object peels from the belt 53 and scatters from soiling the print area PA, and suppress the scattering matter from adhering to the wiper 34*a* and the sealing surfaces of the caps 56, 57.

6. The wiper 34*a* is exchangeable in the printer main body 11*a*. Therefore, in the case where the wiping function of the wiper 34*a* is degraded, the wiping function can be maintained by exchanging the wiper 34. Even if it is hard to wind the fabric sheet 45 because ink having adhered to the wiper 34*a* is solidified by the heat of the heating portion 17, the wiping function can be maintained by the exchange of the wiper 34*a*.

7. A relatively longer space is ensured corresponding to the arrangement space of the wiper unit 34 between the print area PA and the flushing unit 35 in the scanning direction X. Accordingly, when the #1 nozzle row 24*b* of the liquid ejecting head 24 reaches the print area end PE, the control switch limit CL can be positioned closer to the print area PA side than the receiving area end FE. Accordingly, the head controller 61 is required to perform any one of the print control and the flushing control on a single liquid ejecting head 24. That is, for example, it is possible for the controller 61 to avoid performing such complex control in which the flushing control on part of the nozzle rows 24*b* of the single liquid ejecting head 24 and the print control on part of another nozzle rows 24*b* thereof co-exist.

The invention is not limited to the above embodiment, and can be implemented in the following modes.

The maintenance portion may not include a cleaning function, and may be so configured as to include only a moisture cap that has only a moisturizing function for moisturizing ink within the nozzles N of the liquid ejecting head 24.

The liquid receiving portion may not be limited to a mobile type such as a belt, and may be a fixed type that is configured with a flushing box or an opening portion formed at an end of the support platform 12. In the case of a mobile type, the liquid receiving portion may be a disposable paper sheet instead of the belt.

The wiping portion may not be limited to a fabric sheet type, and may be a mobile type including a rubber wiper (blade). In this case, a plurality of mobile-type wipers for wiping a unit of one or two nozzle rows may be independently driven, and may be configured so that part of the nozzle rows can be selected and wiped. Further, the wiper may be a fixed type. In this case, the nozzle surface 24*a* is made to move on a fixed-type wiper in a sliding manner by moving the liquid ejecting unit 20 in the scanning direction X, thereby performing the flushing. In the case of a fixed-type wiper, it is also preferable for the wiper to be exchangeable in the printer main body.

The fixing section may not be limited to the heating portion 17 and the blower 18, and may be configured with only the heating portion 17 or the blower 18. Further, the fixing section may be an ultraviolet light irradiation device if a liquid ejected through the nozzles of the liquid ejecting head contains ultraviolet curing resin. In these configurations, by making the receiving area FA be more distanced from the print area PA than the wiping area WA, it is also possible to suppress the mist having adhered to the nozzle surface 24*a* at the time of flushing from being solidified due to the influence of the fixing section.

The number of the liquid ejecting heads 24 included in the liquid ejecting unit 20 may not be limited to two, and may be one, three or more.

The ejection target medium may not be limited to a sheet ST such as paper, fabric, a resin film, or the like, and may be nonwoven fabric, a metal sheet, a ceramic sheet, or the like; further, the ejection target medium may not be limited to a sheet shape, and may be a solid object or the like.

The liquid ejecting apparatus is not limited to the printer of the above embodiment (recording apparatus) that ejects ink, and may be a liquid ejecting apparatus that ejects and discharges a liquid aside from ink. Note that the state of the liquid ejected from the liquid ejecting apparatus as extremely fine droplets is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in a state of liquid phase, including liquids having high or low viscosity, sol, gel water, other inorganic solvents, organic solvents, liquid solutions, liquid resins, and fluids such as liquid metals (metallic melt). Furthermore, in addition to liquids as one state of matter, liquids in which the particles of a functional material composed of a solid matter such as pigments, metal particles, or the like are dissolved, dispersed, or mixed in a solvent are included as well. As a representative example of a liquid, ink as described in the above embodiment, liquid crystals, and the like can be given. Here, "ink" includes general water-based and oil-based inks, as well as various types of liquid compositions, including gel inks, hot-melt inks, and so on. Liquid ejecting apparatuses that eject liquids containing materials such as electrode materials, coloring materials, and so on in a dispersed or dissolved state for use in the manufacture and so on of, for example, liquid-crystal displays, EL (electroluminescence) displays, surface emitting displays, and color filters can be given as specific examples of liquid ejecting apparatuses. Alternatively, the liquid ejecting apparatus may be a liquid ejecting apparatus that ejects bioorganic matters used in the manufacture of biochips, a liquid ejecting apparatus that is used as a precision pipette and that ejects liquids to be used as samples, textile printing equipment, a microdispenser, and so on. Furthermore, the invention may be employed in liquid ejecting apparatuses that perform pinpoint ejection of lubrication oils into the precision mechanisms of clocks, cameras, and the like, as well as in liquid ejecting apparatuses that eject transparent resin liquids such as ultraviolet curing resins onto a substrate in order to form miniature hemispheric lenses (optical lenses) for use in optical communication elements. The invention may also be employed in a liquid ejecting apparatus that ejects an etching liquid of acid or alkali onto a substrate or the like for etching.

The entire disclosure of Japanese Patent Application No. 2013-045078, filed Mar. 7, 2013 is expressly incorporated by reference herein.

What is claimed is:

1. A liquid ejecting apparatus comprising:

a liquid ejecting unit that includes a liquid ejecting head moving back and forth in a scanning direction, the liquid ejecting head having a nozzle surface in which nozzles capable of ejecting liquid are formed;

a wiping portion that wipes the nozzle surface;

a liquid receiving portion that is capable of receiving the liquid ejected through the nozzles; and a maintenance portion that performs maintenance on the liquid ejecting head, wherein a movement region in which the liquid ejecting head can move includes:

a landing area where the liquid ejected through the nozzles toward an ejection target medium lands, the landing area having a landing area end nearest to the maintenance portion in the scanning direction toward the maintenance portion;

a wiping area where the wiping portion is provided;

a receiving area where the liquid receiving portion is provided; and a maintenance area where the maintenance portion is provided, wherein the receiving area is disposed at a position that is adjacent to the wiping area and is more distanced from the landing area end in the scanning direction than a distance between peripherally formed nozzles in the scanning direction.

2. The liquid ejecting apparatus according to claim 1, wherein the maintenance portion includes a cap capable of forming a sealed space by making contact with the liquid ejecting unit, and the maintenance area is disposed at a position which is adjacent to the receiving area and is more distanced from the landing area than the receiving area in the scanning direction.

3. The liquid ejecting apparatus according to claim 1, further comprising:

a fixing section configured to fix the liquid that has landed on the ejection target medium in a region corresponding to the landing area in the scanning direction.

4. The liquid ejecting apparatus according to claim 1, wherein the wiping portion is disposed in an exchangeable manner in a liquid ejecting apparatus main body.

5. The liquid ejecting apparatus according to claim 1, wherein the wiping portion includes a fabric sheet and a support unit that supports part of the fabric sheet in a projected state so as to make the supported part be in contact with the nozzle surface, and the part of the fabric sheet supported by the support unit is provided in a changeable manner by moving the fabric sheet in a lengthwise direction of the fabric sheet.

6. The liquid ejecting apparatus according to claim 1, wherein the liquid receiving portion includes a strip-shaped member having a liquid receiving surface and is configured so that a receiving range on the strip-shaped member can be changed by moving the strip-shaped member.

7. The liquid ejecting apparatus according to claim 1, wherein a wiping area is disposed between the landing area and the receiving area and accommodates a width in the scanning direction of the nozzle surface.

8. The liquid ejecting apparatus according to claim 1, wherein the wiping portion wipes the nozzle surface in a transport direction of an ejection target medium.

9. A liquid ejecting apparatus comprising:

a liquid ejecting unit that includes a plurality of liquid ejecting heads moving back and forth in a scanning direction, each of the plurality of liquid ejecting heads having a nozzle surface in which nozzles capable of ejecting liquid are formed;

a wiping portion that sequentially wipes the nozzle surfaces in the scanning direction, each of the nozzle surfaces being wiped in a back-and-forth movement in a transport direction of the ejection target medium;

a liquid receiving portion that is capable of receiving the liquid ejected through the nozzles; and a maintenance portion that performs maintenance on the plurality of liquid ejecting heads, wherein a movement region in which the plurality of liquid ejecting heads can move includes:

a landing area where the liquid ejected through the nozzles toward an ejection target medium lands, the landing area having a landing area end nearest to the maintenance portion in the scanning direction toward the maintenance portion;

a wiping area where the wiping portion is provided;

a receiving area where the liquid receiving portion is provided; and a maintenance area where the maintenance portion is provided, wherein the receiving area is disposed at a position that is adjacent to the wiping area and is more distanced from the landing area end in the scanning direction than a distance between peripherally formed nozzles on one liquid ejecting head in the scanning direction.

* * * * *